US005347082A

United States Patent [19]

Ojima

[11] Patent Number: 5,347,082

[45] Date of Patent: Sep. 13, 1994

[54] AUTOMATIC MUSICAL PLAYING INSTRUMENT HAVING PLAYING ORDER CONTROL OPERABLE DURING PLAYING

[75] Inventor: Fumihiko Ojima, Hamamatsu, Japan

[73] Assignee: Yamaha Corporation, Hamamatsu, Japan

[21] Appl. No.: 843,577

[22] Filed: Feb. 28, 1992

[30] Foreign Application Priority Data

Mar. 1, 1991 [JP] Japan ..... 3-036320

[51] Int. Cl.[5] ..... G10H 7/00; G04B 13/00; A63H 5/00

[52] U.S. Cl. ..... 84/609; 84/649

[58] Field of Search ..... 84/DIG. 29, 609, 615, 84/649, 653, 611, 633

[56] References Cited

U.S. PATENT DOCUMENTS

| | | | |
|---|---|---|---|
| Re. 33,607 | 6/1991 | Yuzawa et al. | 84/609 |
| 4,387,620 | 6/1983 | Okamoto et al. | 84/611 |
| 4,656,535 | 4/1987 | Usui | 369/47 X |
| 4,903,565 | 2/1990 | Abe | 84/611 |
| 4,930,390 | 6/1990 | Kellogg et al. | 84/633 |
| 4,942,551 | 7/1990 | Klappert et al. | 364/900 |
| 5,085,116 | 2/1992 | Nakata et al. | 84/609 |
| 5,189,237 | 2/1993 | Koguchi | 84/609 |
| 5,194,682 | 3/1993 | Okamura et al. | 84/625 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An automatic musical playing instrument comprises a memory for storing playing data of a plurality of pieces of music, a playing order memory for storing playing order of the pieces of music stored in the memory and an order change switch which is valid during playing. The playing order can be changed by the order change switch during playing. If the playing order is changed, the music of the changed order is played after the present playing is ended. The instrument includes a mode memory for storing a mode as to whether a pause should be made after the present playing is ended, and a mode change switch which is valid during playing. If the mode change is designated during the playing, the designated mode to be changed is set when the present playing is ended.

19 Claims, 9 Drawing Sheets

AUTOMATIC MUSICAL PLAYING INSTRUMENT HAVING PLAYING ORDER CONTROL OPERABLE DURING PLAYING

BACKGROUND OF THE INVENTION

1. Field of the Invention

The present invention relates to an electronic musical instrument, particularly to an automatic musical playing instrument which is capable of automatically playing pieces of music successively.

2. Prior Art

There have been automatic musical playing instruments which are capable of storing playing data of pieces of music. These instruments may be sometimes required to play the pieces of music successively. Therefore, a conventional improved instrument is arranged so that the order of the pieces of music is previously determined, and the automatic playing is performed successively according to the order. Another conventional improved instrument is arranged so that a pause mode for making a pause between two pieces of music and a continuation mode for continuing pieces of music can be selected.

The above conventional instruments are limited in setting of the playing order. The playing order can be set only before the automatic musical playing, but can't be set during the automatic musical playing. Therefore, even if a player notices inconvenience, it is impossible to change immediately the order into the desired one. Making a stop of the automatic playing is required to change the order. Players must in advance decide the order carefully, because the change of the order is impossible after the automatic musical playing.

SUMMARY OF THE INVENTION

It is therefore an object of the present invention to provide an automatic musical playing instrument which is capable of rewriting playing order during automatically playing.

It is another object of the present invention to provide an automatic musical playing instrument which is capable of rewriting a mode during automatically playing as to whether a pause should be made after the present playing is ended.

In accordance with the present invention an automatic musical playing instrument comprising, memory means for storing playing data of a plurality of pieces of music, playing means for reading the playing data from the memory means and for automatically playing according to the read data, playing order memory means for storing playing order of the pieces of music stored in the memory means, order change designation means, operation of which is valid during playing, for designating a change of the playing order stored in the playing order memory means, and playing control means for controlling the playing order so that if the change of next music has been designated by the order change designation means, the playing data of the changed music in place of previously stored music in the playing order memory means is supplied to the playing means, otherwise unless any change of the next music has been designated by the order change designation means, the playing data of the previously stored music in the playing order memory means is supplied to the playing means.

The playing means plays usually according to the order of the playing data in the memory means. While, if the change of the playing order is designated by the order change designation means during the present playing, the changed music is played in place of the previously stored music after the present music is ended.

The automatic musical playing instrument includes mode memory means for storing a mode as to whether the playing means pauses or plays succesively after the playing means ends the playing of a piece of music, mode change designation means for designating the mode to be changed according to the operation which is valid during playing, and playing control means for controlling the mode so that if a mode change has been designated, the designated mode to be changed is set when the present playing is ended, otherwise if mode the change has not been designated, the mode previously stored in the mode memory means is set When the present playing is ended.

The playing control means sets usually the mode according to the mode previously stored in the mode memory means. While, if the mode change is designated during the playing, the designated mode to be changed is set when the present playing is ended.

DETAILED DESCRIPTION OF THE PREFERRED EMBODIMENTS

Figure 1:
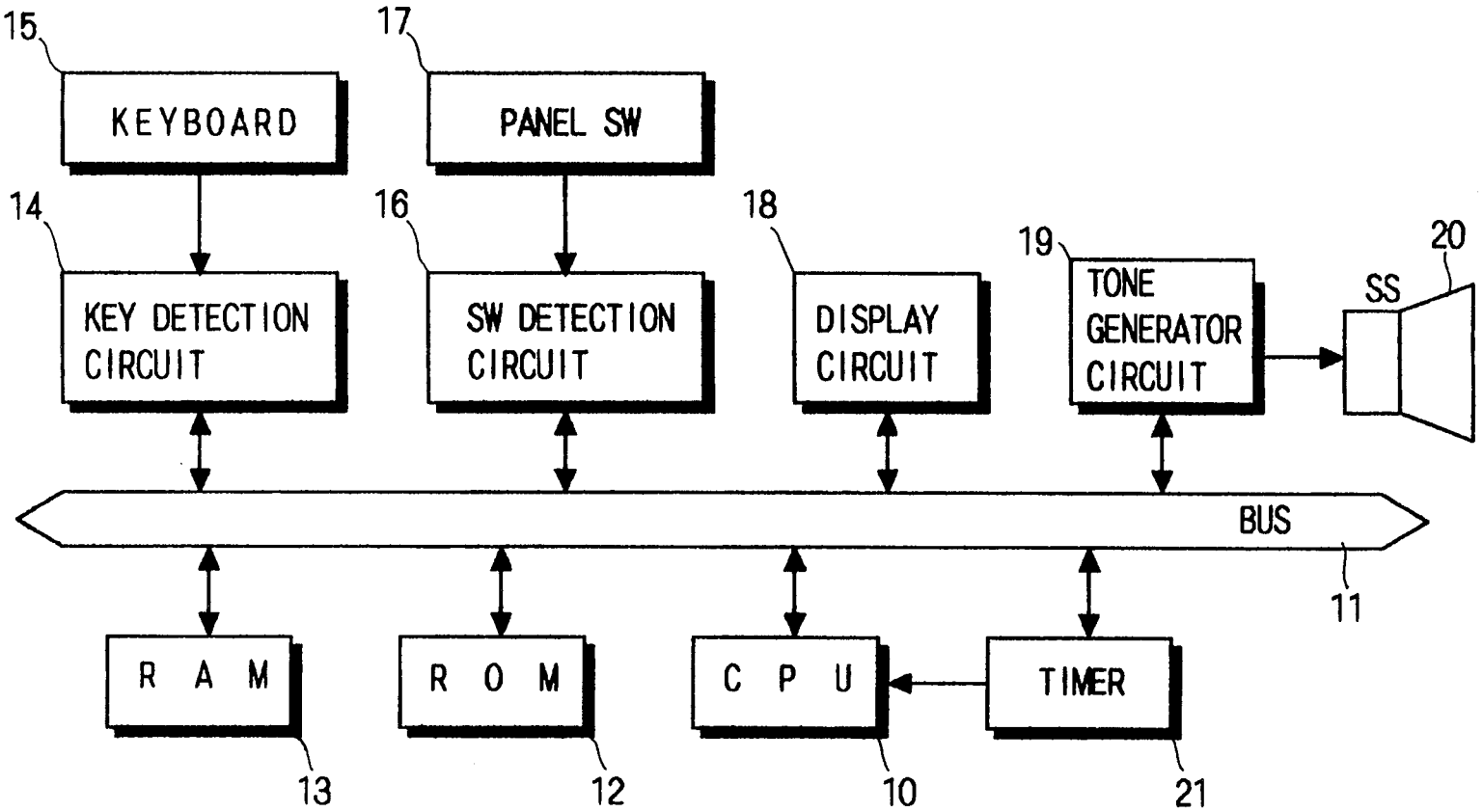
FIG. 1 is a block diagram of an automatic musical playing instrument embodying the present invention.

Referring to the drawings, an automatic musical playing instrument embodying the present invention is described below.

The automatic musical playing instrument has a function of being capable of reading a plurality of pieces of music (song data) successively from a RAM to automatically play. A player can set a playing order of music to a desired one. Also, the playing order can be changed not only before the playing but also during the playing.

FIG. 1 is a block diagram of the automatic musical playing instrument. This instrument is controlled by a CPU 10. The CPU 10 is connected to a ROM 12, a RAM 13, a key detection circuit 14, a switch detection circuit 16, a display circuit 18, a tone generator circuit 19, and a timer 21 through a bus 11. The key detection circuit 14 is connected to a keyboard 15, and the switch detection circuit 16 is connected to a panel switch 17 which is equipped in an operation panel. The timer 21 is connected to an interruption terminal of the CPU 10, and interrupts the CPU 10 for every clock timing previously set. The ROM 12 stores a program shown as a flowchart described later. The RAM 13 stores a plurality of the song data each of which is represented by the format shown in FIG. 3. Also, a portion of the RAM 13 is allotted to registers and flags. The key detection circuit 14 detects on-off status and touch data of each key in the keyboard 15. The switch detection circuit 16 detects on-off status of the panel switch 17. The panel switch 17 includes function switches 31 to 33 and +/− switches 34, 35, further a play switch and a stop switch. The display circuit 18 includes an LCD display 30 shown in FIG. 2, and controls the LCD display 30. The tone generator circuit 19 is provided with a plurality of tone generation channels, and generates musical tone signals according to parameters inputted from the CPU 10. The musical tone signals is outputted to a sound system 20 to output them to a speaker.

Figure 2:
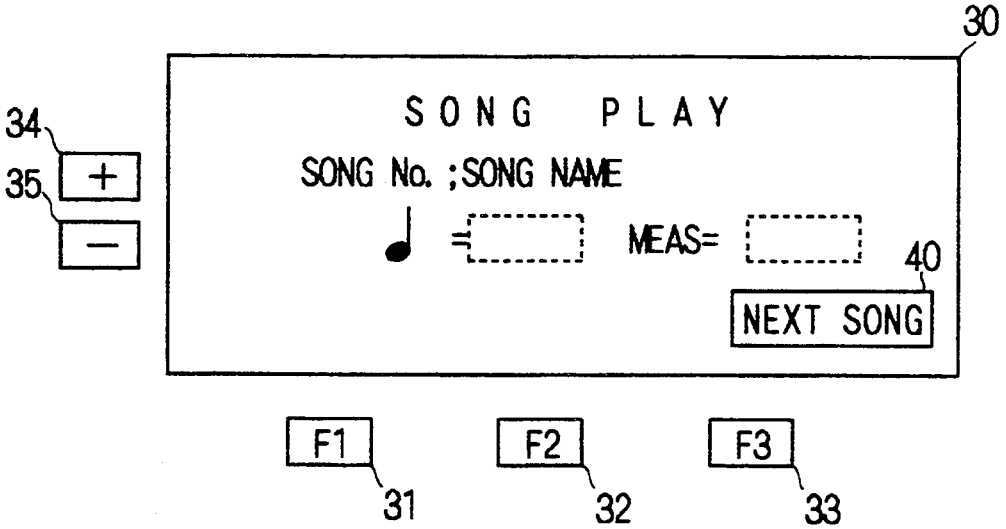
FIG. 2 shows an arrangement near a display of the automatic musical playing instrument.
Figure 2:
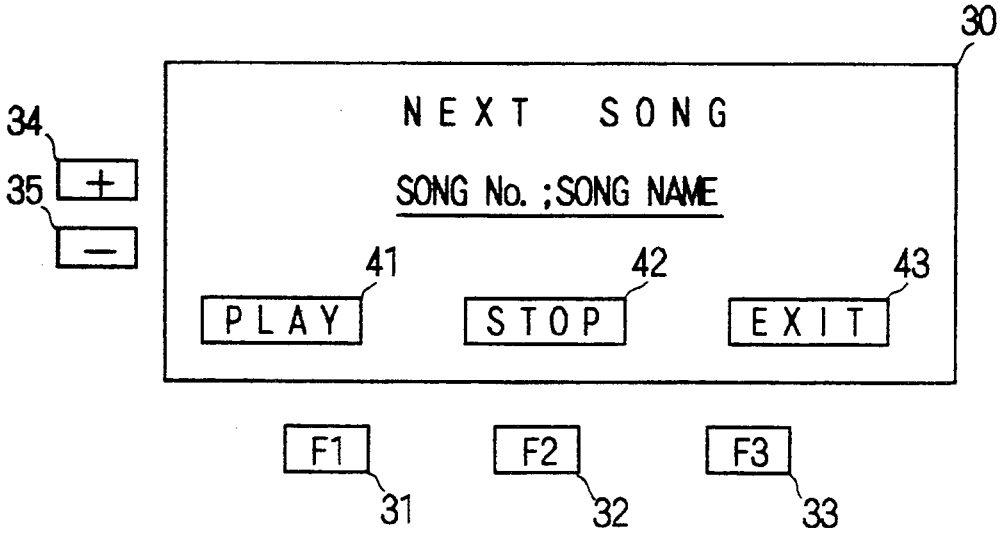

FIG. 2 shows a portion of the operation panel, and a display example of the LCD display. FIG. 2(A) shows a display example during the automatic playing, and FIG. 2(B) shows a display example in a music order change mode during the automatic playing. The function switches 31 to 33 are provide below the LCD display 30, and the plus switch 34 and the minus switch 35 are provided on the left side of the LCD display 30. The functions of the function switches 31 to 33 depend on a process mode of the instrument. The function is displayed in the LCD display 30 (see the numbers 40 to 43 in FIG. 2). Only the function switch 33 is valid during the automatic playing mode (SONG PLAY mode) as shown in FIG. 2(A). If the switch 33 is depressed the mode moves to the music order change mode (NEXT SONG mode). In the music order change mode, the function switches 31 to 33 can be operated respectively as a continuous playing switch (PLAY switch), a pause switch (PAUSE switch), and a mode release switch (EXIT switch). These functions are displayed in the LCD display 30 (see the numbers 41 to 43 in FIG. 2(B)). In the music order change mode, if the plus switch 34 or the minus switch 35 is depressed, the song number to be played next is increased or decreased, respectively. If the song number is changed by operation of the switches, the displayed song number and the music title in the display 30 are also changed.

Figure 3:
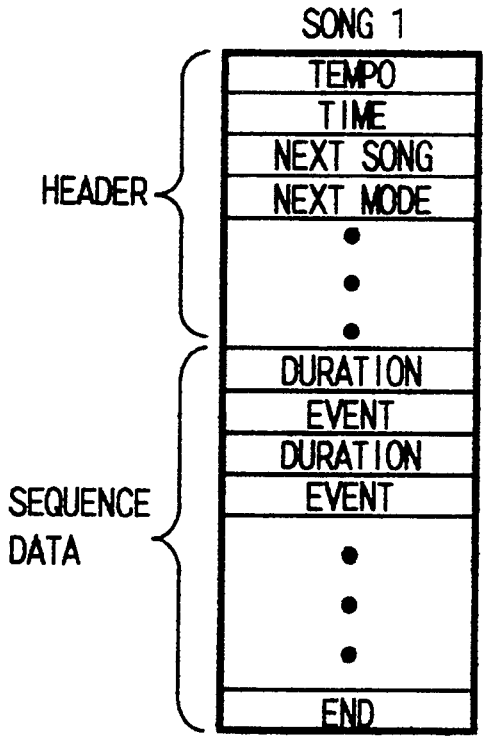
FIG. 3 shows a format of the song data stored in the automatic musical playing instrument.

FIG. 3 shows the format of the song data stored in the RAM 13. The figure shows the format of a song (SONG 1). The beginning area of the song data is a header which consists of tempo data, time data, next song data, next mode flag or the like. The header precedes sequence data which includes sets of duration data and event data. The data is successively read from the beginning to automatically play. The next song data represents the next song number to be played next. If the next song data is zero, which means that no next song is designated, the process will stop when the present song is ended. The next mode flag represents the status as to whether the next song should be started or the pause should be made when the present song is ended.

FIGS. 4 to 12 are flowcharts to show a process of the automatic musical playing instrument.

Figure 4:
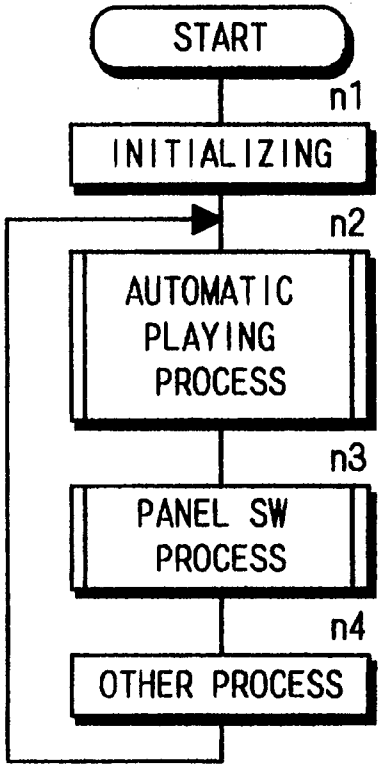

FIG. 4 is a main flowchart. When a power of the automatic musical playing instrument is turned on, an initializing of registers and so on is performed (n1). After that, an automatic playing process (n2, see FIG. 6), a panel switch process (n3, see FIG. 7), and the other process (n4) are repeatedly performed. The other process includes a main volume control process or the like.

Figure 5:
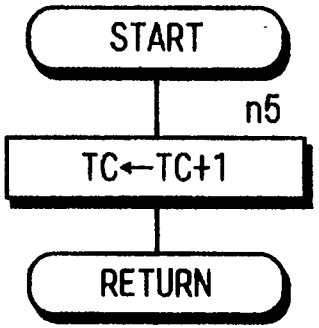
FIGS. 4 to 12 are flowcharts showing a process of the automatic musical playing instrument.

FIG. 5 is a timer interruption process. The process is carried out by every timer interrupt from the timer 21 based on the previously designated tempo. In this process, a tempo clock register TC is incremented (n5).

Figure 6:
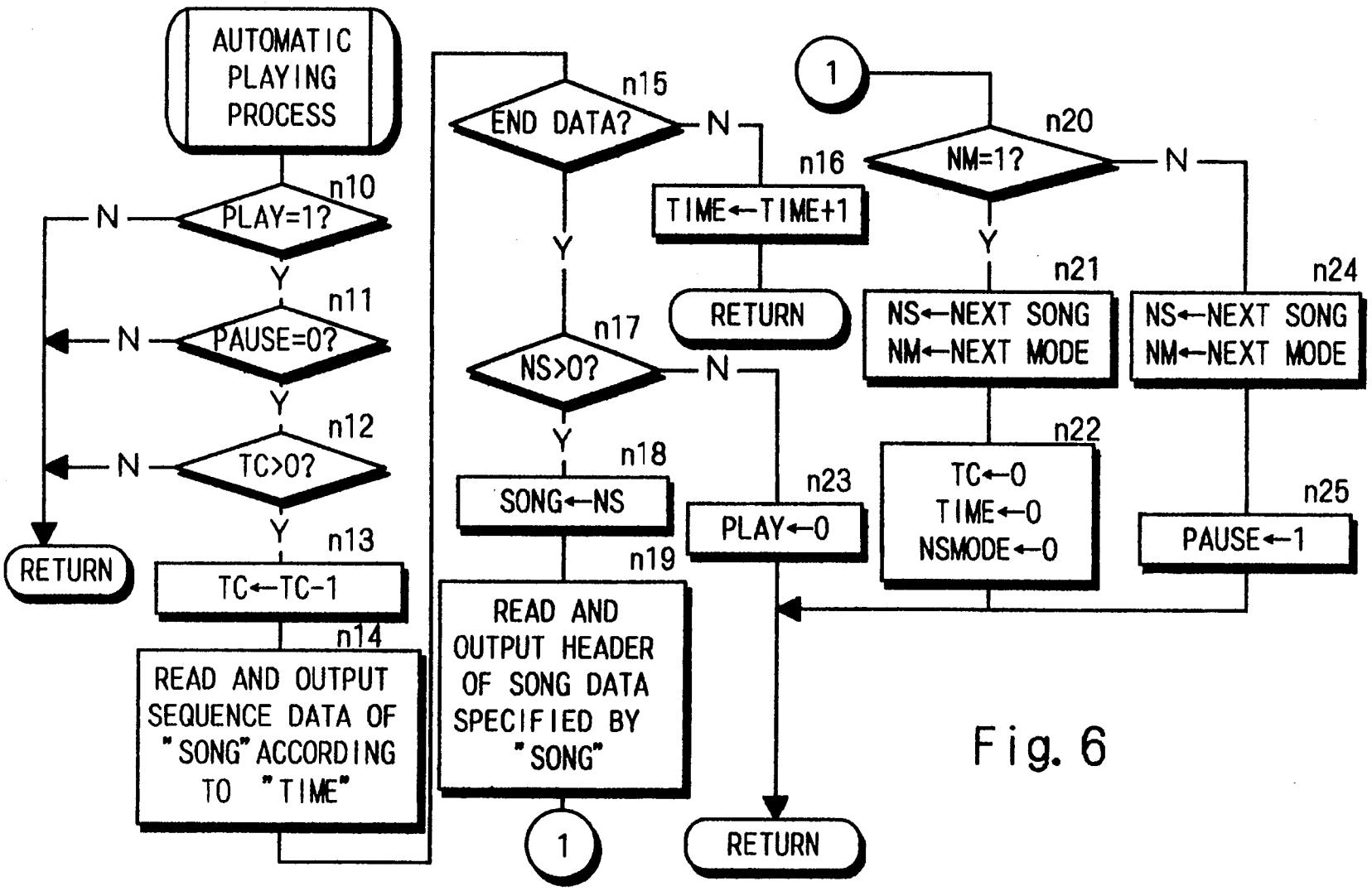

FIG. 6 is the automatic playing process. The process is carried out during the automatic playing process. First, whether a play flag PLAY is "1", a pause flag PAUSE is "0", and the tempo clock register TC is "1" or more are judged (n10, n11, n12). The play flag PLAY is a flag which represents whether the present status is in the automatic playing or not. The pause flag PAUSE is a flag which represents whether the present status is in the pause or not. The tempo clock register TC is a register which is incremented for each timer interruption. If the resister TC indicates "0" or more, it represents the timing for the automatic playing process. If the above conditions are satisfied, the process proceeds to the step n13, otherwise the process returns to the main routine.

At the step n13, the tempo clock resister TC is decremented. A time resister TIME is a time count resister to be counted based on the tempo clock resister TC. If there is any duration data which coincides with the data of the time resister TIME, the event data corresponding to the duration data is read and outputted to generate musical tones (n14). If there is no duration data which coincides with the data of the time resister TIME, nothing is done. If the read data (event data) is end data, the process moves to the step n17, otherwise, the time resister TIME is incremented (n16), and the process returns.

At the step n17, the next song data NS is judged. If the next song data NS is "0", it means that a next song isn't specified. Therefore, the play flag PLAY is set to "0" (n23), and the process returns. If the data NS is more than "0", the data NS is set in a song number register SONG to automatically play the song of the data NS (n18). The header of the song data specified by the resister SONG is read and outputted to some circuits (n19). Next, a next mode flag NM is judged (n20). If the flag NM is "1", the header data of new music is set in the next song data NS and the flag NM for preparing the next process (n21). After that, the registers TC, TIME and NSMODE are cleared (n22), and the process returns. The automatic playing will carry out after the completion of the step n22. While, the next mode flag NM is "0", the same process as the step n21 is performed (n24), and the pause flag PAUSE is set to "1" (n25) before the process returns. The automatic playing is started when the play switch is depressed.

Figure 7:
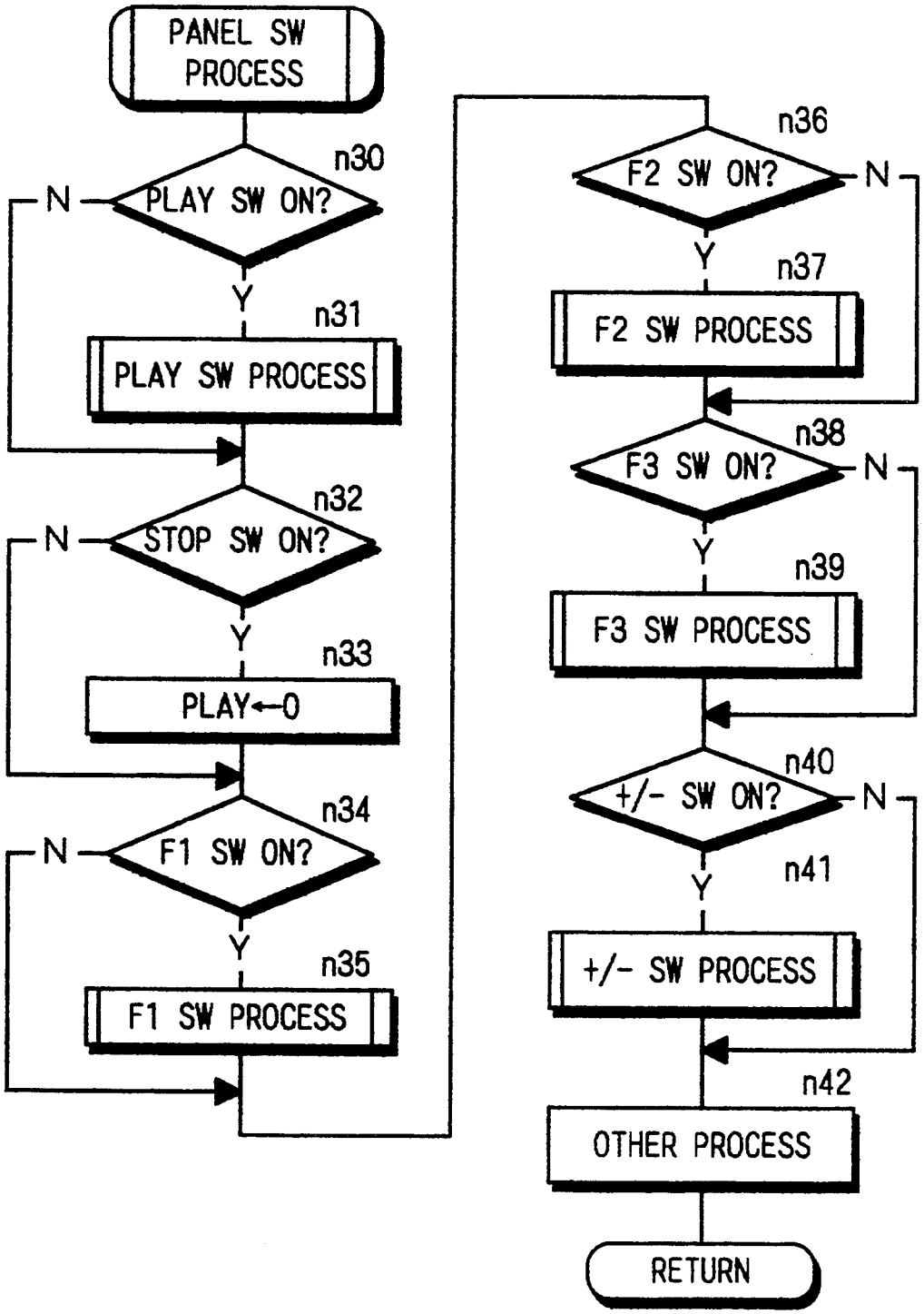

FIG. 7 is a flowchart showing the panel switch process.

The process is a process to scan the panel switch to detect an on-event of any switch and to perform the process corresponding to the on-event switch. If the play switch is depressed a play switch process (n31) is performed, if the stop switch is depressed the play flag PLAY is set to "0" (n33), and if the function F1 switch 31 is depressed an F1 switch process is performed (n35). If the function F2 switch is depressed an F2 switch process is performed (n37). While, if the function F3 switch is depressed an F3 switch process is performed (n39), and if each of the +/− switches 34, 35 is depressed a +/− switches process is performed (n41). If other switch is depressed a corresponding process is performed (n42).

Figure 8:
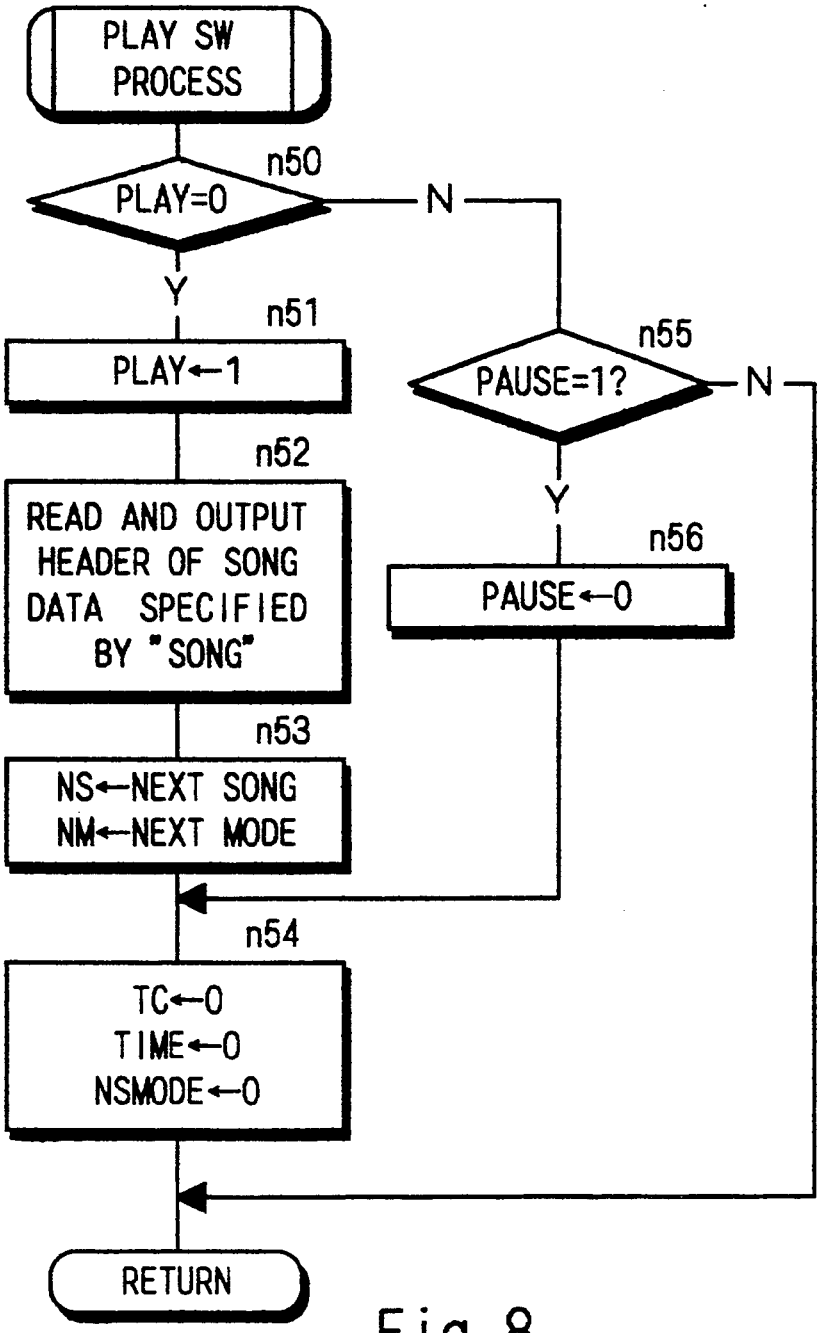

FIG. 8 is a flowchart showing the play switch process. The process is started when the play switch is depressed. First, the status of the play flag PLAY and the pause flag PAUSE is judged (n50, n55). If the play flag PLAY is "0", it means that the automatic playing is started. Therefore the play flag PLAY is set to "1" (n51), and the header of the song data specified by the song number resister SONG is read and outputted to the registers (n52). After that, the next song data and the next mode flag in the header are set as NS and NM to resistors (n53). The tempo clock register TC, the timing resister TIME and the mode flag NSMODE are cleared (n54), and the process returns. If the mode flag NSMODE is "0", the display 30 displays the contents as shown in FIG. 2(A). While, if the mode flag NSMODE is "1", the display 30 displays the contents as shown in FIG. 2(B). If the play flag PLAY is "1" and the pause flag PAUSE is "1", it means that the pause situation is reset to start the playing for a new song. Therefore, the pause flag PAUSE is reset (n56), and the process proceeds to the step n54. If the play flag PLAY is "1" and the pause flag PAUSE is "0", it means that the instrument is in automatic playing. Therefore, the process returns immediately.

Figure 9:
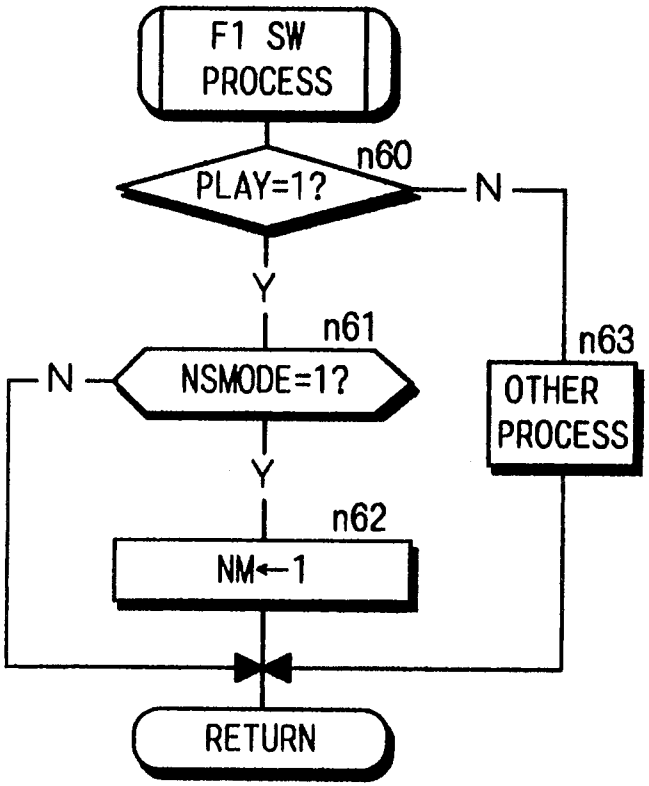

FIG. 9 is a flowchart showing the F1 switch process. First, the play flag PLAY is judged (n60). If the flag PLAY is "1", the mode flag NSMODE is judged (n61). If the mode flag NSMODE is "1", the next mode flag NM is set to "1" (n62). Otherwise, if the display mode flag NSMODE is "0", it means that no function is assigned to the F1 switch 31. Therefore, the process returns immediately. While, if the play flag PLAY is "0" at the step n60, the process corresponding to the present mode is performed (n63) and the process returns.

Figure 10:
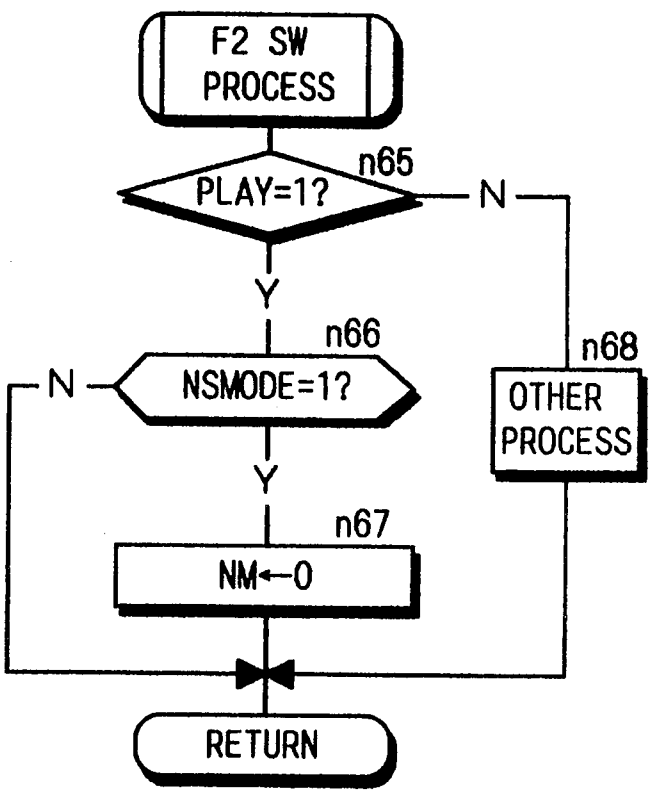

FIG. 10 is a flowchart showing the F2 switch process. First, the play flag PLAY is judged (n65). If the flag PLAY is "1", the mode flag NSMODE is judged (n66). If the flag NSMODE is "1", the next mode flag NM is set to "0" (n67). Otherwise if the flag NSMODE is "0", it means that no function is assigned to the F2 switch 32, and the process returns immediately. While, if the play flag PLAY is "0" at the step n65, the process corresponding to the present mode is performed (n68) and the process returns.

Figure 11:
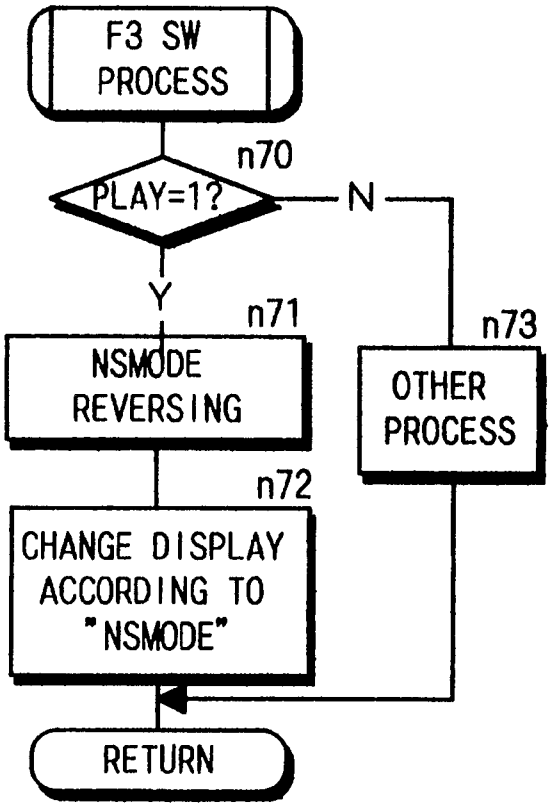

FIG. 11 is a flow chart showing the F3 switch process. First, the play flag PLAY is judged (n70). If the flag PLAY is "1", the mode flag NSMODE is reversed (n71). The display content of the display 30 is switched to that corresponding to the flag NSMODE (n72). While, if the play flag PLAY is "0" at the step n70, the process corresponding to the present mode is performed (n73) and the process returns.

Figure 12:
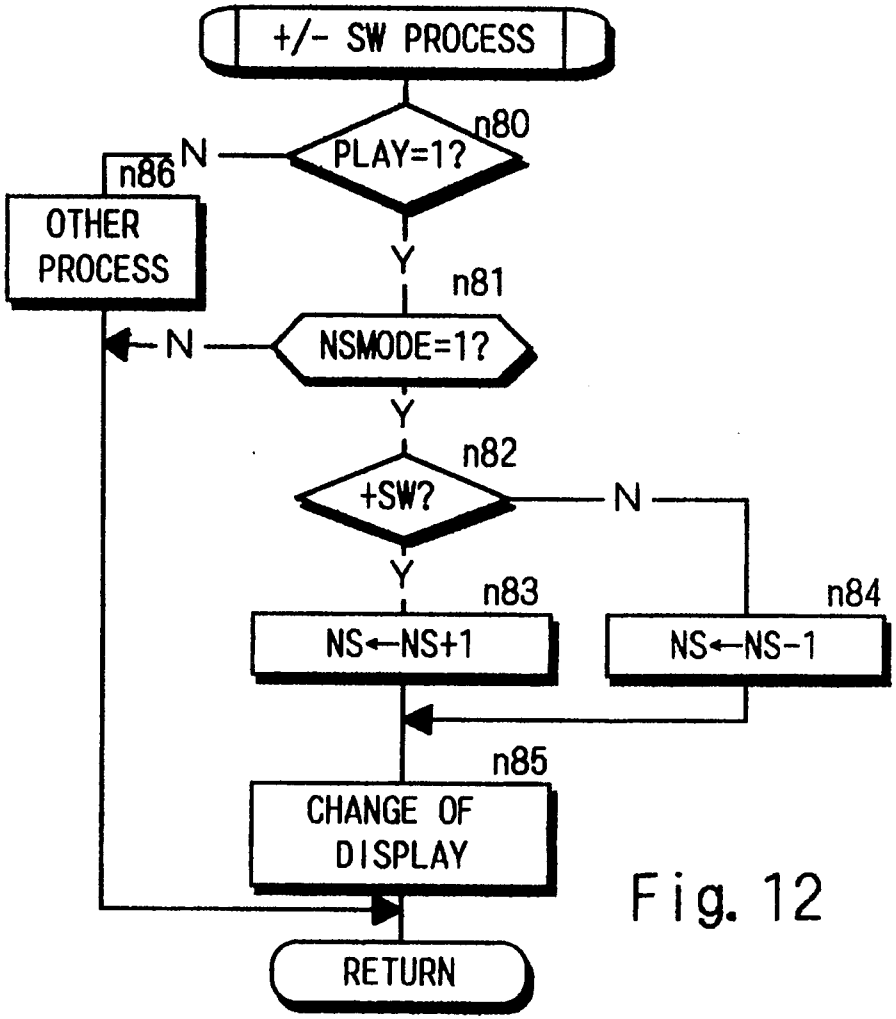

FIG. 12 is a flowchart showing the +/− switches process. If each of the switches is depressed, the play flag PLAY is judged first (n80). If the flag is "1", the processes from the step n81 are performed. If the flag is "0", the process corresponding to the present mode is performed (n86) and the process returns. At the step n81, the flag NSMODE is judged. If the flag NSMODE isn't "1", it means that no function is assigned to the switches and the process returns immediately. If the flag NSMODE is "1", the next song resister MS is incremented or decremented according to the depressed switch (+ switch or − switch) (n83, n84). After that, the displayed contents of the display 30 are changed so that the song number and the song name are displayed thereon (n85), and the process returns.

The above described embodiment is arranged so that the next song number NS of the song to be played next is stored in the header of the song data. It is possible to store the music playing order in any area separated from the area in which the song data is stored. In addition, the music playing order changed by a player can be hold and also validated during only one playing.

In addition, it is available to provide a flag for representing whether any music change designation or playing order change designation is specified and a memory for storing data to be changed. If the flag represents the music change, the playing order is changed according to the data in the memory. Otherwise, the previously specified playing order in the memory is carried out.

What is claimed is:

1. An automatic musical playing instrument comprising:

memory means for storing playing data of a plurality of pieces of music;

playing means for reading the playing data from the memory means and for automatically playing according to the read data;

playing order memory means for storing a playing order of the pieces of music stored in the memory means;

order change designation means, operable during playing of playing data, for designating a change of the playing order stored in the playing order memory means; and playing control means for controlling the playing order so that if the change of next music has been designated by the order change designation means, the playing data of the changed music in place of previously stored music in the playing order memory means is supplied to the playing means, otherwise the playing data of the previously stored music in the playing order memory means is supplied to the playing means.

2. An automatic musical playing instrument according to the claim 1, further comprising display means for displaying the operation of the order change designation means during the playing.

3. An automatic musical playing instrument as set forth in claim 1, wherein said playing order is assigned to a header area of each of said playing data.

4. An automatic musical playing instrument according to the claim 1, wherein said playing control means stops the playing when there is no playing data in said memory means.

5. An automatic musical playing instrument as set forth in claim 1, further comprising starting means for starting the playing means when said playing means pauses.

6. An automatic musical playing instrument comprising:

memory means for storing playing data of a plurality of pieces of music;

playing means for reading the playing data from the memory means and for automatically playing according to the read data;

playing order memory means for storing a playing order of the pieces of music stored in the memory means;

order change designation means, operable during playing of playing data, for designating a change of the playing order stored in the playing order memory means; and playing control means for controlling the playing order so that if the change of next music has been designated by the order change designation means, the playing data of the changed music in place of previously stored music in the playing order memory means is supplied to the playing means, otherwise the playing data of the previously stored music in the playing order memory means is supplied to the playing means;

mode memory means for storing a mode as to whether said playing means pauses or plays successively after the playing means ends the playing of a piece of music; and mode change designation means, operable during playing of the playing data, for designating the mode to be changed.

7. An automatic musical playing instrument comprising:

memory means for storing playing data of a plurality of pieces of music;

playing means for reading the playing data from the memory means and for automatically playing according to the read data;

mode memory means for storing a mode as to whether the playing means pauses after the playing means ends the playing of a piece of music;

mode change designation means, operable during playing, for designating the mode stored in the mode memory means to be changed; and playing control means for controlling the mode so that if a mode change has been designated by the mode change designation means, the designated mode to be changed is set when the playing is ended, and if a mode change has not been designated by the mode change designation means, the mode previously stored in the mode memory means is set when the playing is ended.

8. An automatic musical playing instrument as set forth in claim 7, further comprising display means for displaying the operation of the mode change designation means during the playing.

9. An automatic musical playing instrument as set forth in claim 7, wherein said mode memory means is assigned to a header area of each of said playing data.

10. An automatic musical playing instrument as set forth in claim 7, further comprising playing order memory means for storing order data stored in said memory means, and playing order means for controlling the playing order according to the playing order data.

11. A method of playing a plurality of musical pieces in an automatic musical playing instrument, the method comprising the steps of:

storing playing data of the plurality of pieces of music in a first memory;

storing in a second memory the playing order of the pieces of music stored in the first memory;

reading the playing data from the first memory in the order stored in the second memory and automatically playing according to the read data;

designating a change of the playing order stored in the second memory; and controlling the playing order so that if the change of playing order has been designated, the playing data of the changed music in place of previously stored music is played, otherwise the playing data of the previously stored music is played.

12. A method of playing a plurality of musical pieces in an automatic musical playing instrument as set forth in claim 11, further comprising the step of displaying the changed order of play during the playing.

13. A method of playing a plurality of musical pieces in an automatic musical playing instrument as set forth in claim 11, further comprising the step of assigning the playing order to a header area of each of said playing data.

14. A method of playing a plurality of musical pieces in an automatic musical playing instrument as set forth in claim 11, further comprising the step of stopping the playing when there is no playing data in the first memory.

15. A method of playing a plurality of musical pieces in an automatic musical playing instrument as set forth in claim 11, further comprising the steps of designating a mode for each piece of music as to whether play pauses after the end of playing of each piece of music and storing the mode to be changed.

16. A method of playing a plurality of musical pieces in an automatic musical playing instrument, the method comprising the steps of:

storing playing data of the plurality of pieces of music in a first memory;

storing in a second memory a mode as to whether the playing pauses after the playing of a piece of music;

reading the playing data from the first memory and automatically playing according to the read data;

designating a mode stored in the second memory to be changed; and controlling the mode so that if a mode change has been designated, the designated mode to be changed is set when the playing is ended, and if a mode change has not been designated, the mode previously stored in the second memory is set when the playing is ended.

17. A method of playing a plurality of musical pieces in an automatic musical playing instrument as set forth in claim 16, further comprising the step of displaying the operation of the mode during the playing.

18. A method of playing a plurality of musical pieces in an automatic musical playing instrument as set forth in claim 16, further comprising the step of assigning the mode to a header area of each of said playing data.

19. A method of playing a plurality of musical pieces in an automatic musical playing instrument as set forth in claim 16, further comprising the steps of:

storing order data in the second memory, and controlling the playing order according to the playing order data.

* * * * *